US006342761B1

(12) United States Patent
Reber

(10) Patent No.: US 6,342,761 B1
(45) Date of Patent: Jan. 29, 2002

(54) DISCHARGE LAMP HAVING AN INTERNAL ELECTRODE FORMED OF A SPIRAL BAND

(75) Inventor: Silke Reber, Gelnhausen (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 09/456,401

(22) Filed: Dec. 8, 1999

(30) Foreign Application Priority Data

Dec. 8, 1998 (DE) ..... 198 56 428

(51) Int. Cl.[7] ..... H01J 17/20

(52) U.S. Cl. ..... 313/574; 313/491; 313/607; 313/631

(58) Field of Search ..... 313/491, 574, 313/607, 631, 283

(56) References Cited

U.S. PATENT DOCUMENTS 5,889,367 A 3/1999 Hofmann et al.

FOREIGN PATENT DOCUMENTS

EP 0 767 484 A1 4/1997

*Primary Examiner*—Vip Patel
(74) *Attorney, Agent, or Firm*—Oblon, Spivak, McClelland, Maier & Neustadt, P.C.

(57) ABSTRACT

A discharge lamp having a discharge space is bounded by an external tube formed of dielectric material and by an internal tube formed of dielectric material. An external electrode is arranged proximate the external tube, and an internal electrode rests against the internal tube. The internal electrode is formed from an elastic spiral band having an external diameter that is greater than the internal diameter of the internal tube when the elastic spiral band is not compressed.

20 Claims, 2 Drawing Sheets

DISCHARGE LAMP HAVING AN INTERNAL ELECTRODE FORMED OF A SPIRAL BAND

BACKGROUND OF THE INVENTION

1. Field of the Invention

The present invention relates to a discharge lamp, and more specifically to a discharge lamp having a discharge space bounded by an external tube and an internal tube.

2. Discussion of the Background

An excimer reflector lamp is described in DE-A 196 13 502. The lamp has a closed discharge space constructed as an annular gap between two quartz glass tubes arranged coaxially in relation to each other. The discharge space contains a filler gas that forms excimers under discharge conditions. An external electrode in the form of a net is provided on the external wall of the external quartz glass tube. An internal electrode is formed by a spiral wire lying in the internal wall of the internal quartz glass tube. Upon applying a high voltage between the internal and external electrodes, so-called excimers are formed in the filler gas of the discharge space. Due to the chemical composition of the excimers, the excimers emit essentially monochromatic UV radiation and do not emit coherent radiation. The discharge between the external and internal electrodes passes through the discharge space and forms fine threads of current, which are called filaments.

In conventional excimer reflector lamps, the internal electrodes can be installed in the form of wire spirals. However, the filaments are concentrated in the area of the wire spirals. For applications in which a homogenous distribution of the filaments is desired, it may also be necessary to require uniform contact of the wire spirals with the internal walling of the internal tube.

Another excimer radiation lamp is shown in EP-A1 767 484, which discloses an excimer radiation lamp having an internal electrode constructed in the form of a metal tube with a longitudinal slot running in the direction of the radiation axis. For installation of the internal electrode, the metal tube is rolled together and inserted into the internal tube. In this manner, the internal electrode is caused to firmly contact the inner wall of the internal tube. As a result the, the filaments formed in the discharge space are generally distributed homogeneously. However, the filaments tend to wander along the longitudinal slot with a vertically oriented radiation lamp axis.

SUMMARY OF THE INVENTION

Accordingly, one object of the present invention is to provide a novel discharge lamp having an internal electrode that is easy to install.

It is another object of the present invention to provide a novel discharge lamp that lies fast on an internal wall of the discharge lamp.

It is yet another object of the present invention to provide a novel discharge lamp in which the filaments are homogeneously distributed in the discharge space, even when the discharge lamp is vertically mounted.

These and other objects are achieved according to the present invention by providing a discharge lamp that includes an external tube formed of dielectric material and an internal tube formed of dielectric material. The external tube and the internal tube define a discharge space. An external electrode is arranged proximate the external tube, and a helical internal electrode is arranged adjacent to an inner wall of the internal tube. The internal electrode includes an elastic spiral band, which in a released state, has an external diameter, D, that is larger than an internal diameter, I, of the internal tube.

The helical or spiral shape of the internal electrode advantageously prevents the filaments from wandering independently of the orientation of the discharge lamp. Additionally, since the internal electrode is in the shape of a spiral band, the internal electrode achieves a flat contact on the internal wall of the internal tube, the electric field in the discharge space is homogenized, and the distribution of the filaments is homogenized.

Moreover, the elastic deformability of the spiral band facilitates installation in the internal tube since the spiral band can be extended for placement in the internal tube, rolled together more compactly, and subsequently released so that it expands outward and pushes against the inner wall. This is possible because the spiral band in the released state has an external diameter that is greater than the diameter of the internal tube. As used herein, the term "external diameter" means the maximum diameter of the cross section perpendicular to the long axis of the spiral. The spiral band is in the released state if no external forces are acting upon it (i.e., the spiral band is not compressed).

In addition, the internal electrode serves as a reflector, and it is suited for both straight and curved internal tubes.

Advantageously, the spiral band has a slot or gap between adjacent winding segments. The width of the gap (i.e., the gap width) is preferably between 0.2 mm and 5 mm. As the width of the slot decreases, the distribution of the filaments in the discharge space becomes more homogeneous and the reflecting action of the spiral band becomes more effective. However, as the width of the slot narrows, the deformability of the spiral band diminishes, which makes installation of the spiral band more difficult. Preferably, the width of the slot is between 0.5 mm and 2 mm.

In a preferred embodiment, the spiral band has a flat cross section and a breadth of between 3 mm and 30 mm. More preferably, the breadth of the spiral band is between 5 mm and 10 mm. Increasing the breadth of the spiral band increases and enhances the field homogenizing and reflecting function of the internal electrode. However, increasing the breadth of the spiral band decreases the deformability of the spiral band.

Preferably, the thickness of the spiral band is between 0.1 mm and 1 mm. The spiral band is preferably made of high grade steel or of a spring steel.

In a preferred embodiment, the outer side of the spiral band (i.e., the side of the spiral band that faces the discharge space) is coated with a material that forms a surface that reflects UV radiation. The reflectivity of the surface can be adjusted by changing the type of material or by adjusting the degree to which the surface is polished.

The internal electrode formed by the elastic spiral band is especially suited to a discharge lamp with a bent internal tube. Given its pliability, the internal electrode can adapt to the bends in the internal tube. The bends in the tube can be either a kink or a continuous curve. For example, the curves can be circular, semicircular, banana-shaped or U-shaped.

The spiral band of the present invention is particularly well suited for use in a discharge lamp having a discharge space filled with a gas that forms excimers when the electrodes of the lamp discharge.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
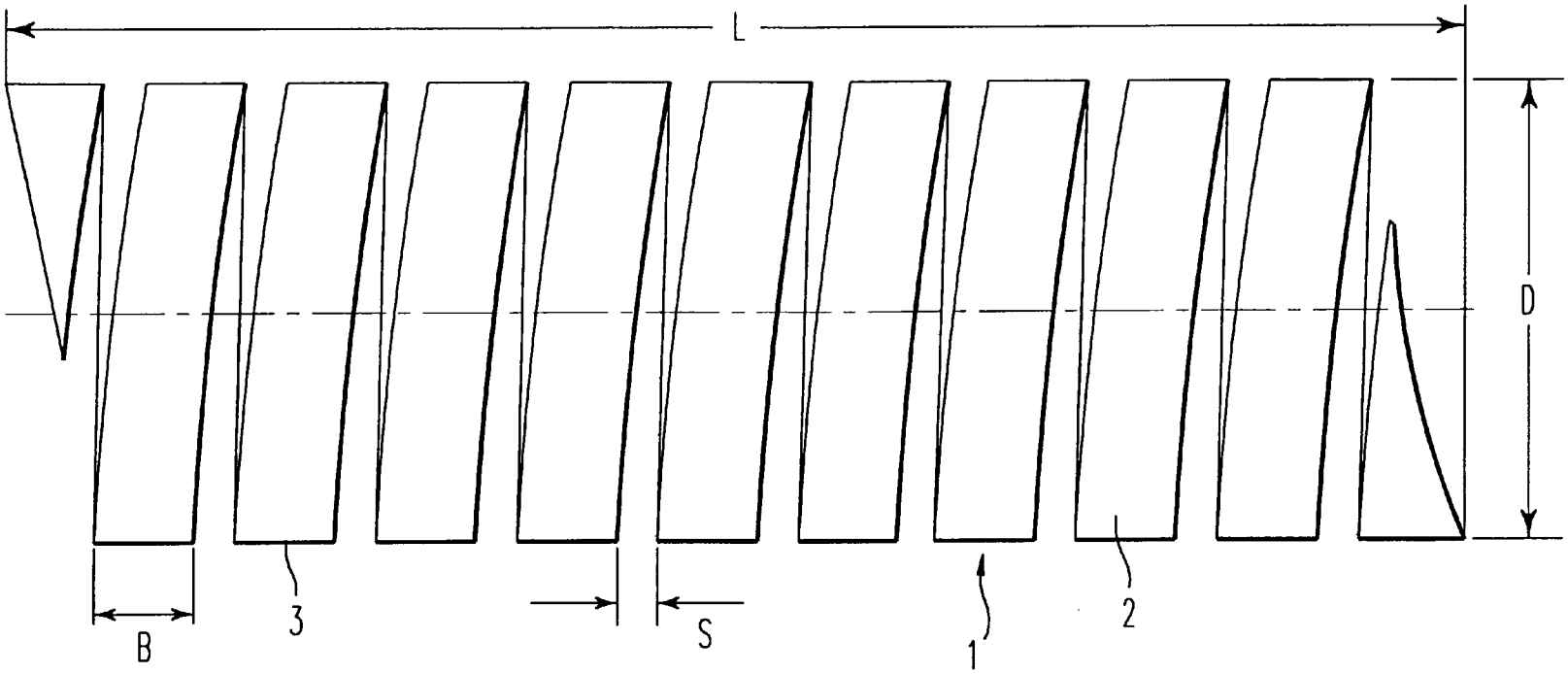
FIG. 1 depicts is a lateral view of an internal electrode for a discharge lamp.

Referring now to the drawings, wherein like reference numerals designate identical or corresponding parts throughout the several views, FIG. 1 shows an internal electrode 1 for use in an excimer reflector lamp. The internal electrode 1 is formed from an elastic spiral band 2 of elastic, high grade steel (e.g., 18/8 CrNi steel) with a thickness of 0.5 mm and a breadth, B, of 6 mm. The internal electrode 1 has an external diameter, D, of 17 mm and a length, L, of 160 mm in the released state.

A uniform slot or gap, S, is provided between adjacent winding segments. The gap has a width (i.e., a gap width) of 1.3 mm.

The metal strip has an outer side 3 that faces outward relative to the long axis of the internal electrode 1. The outer side 3 is completely flat and is preferably polished so that the outer side 3 has a sparkling surface.

Figure 2:
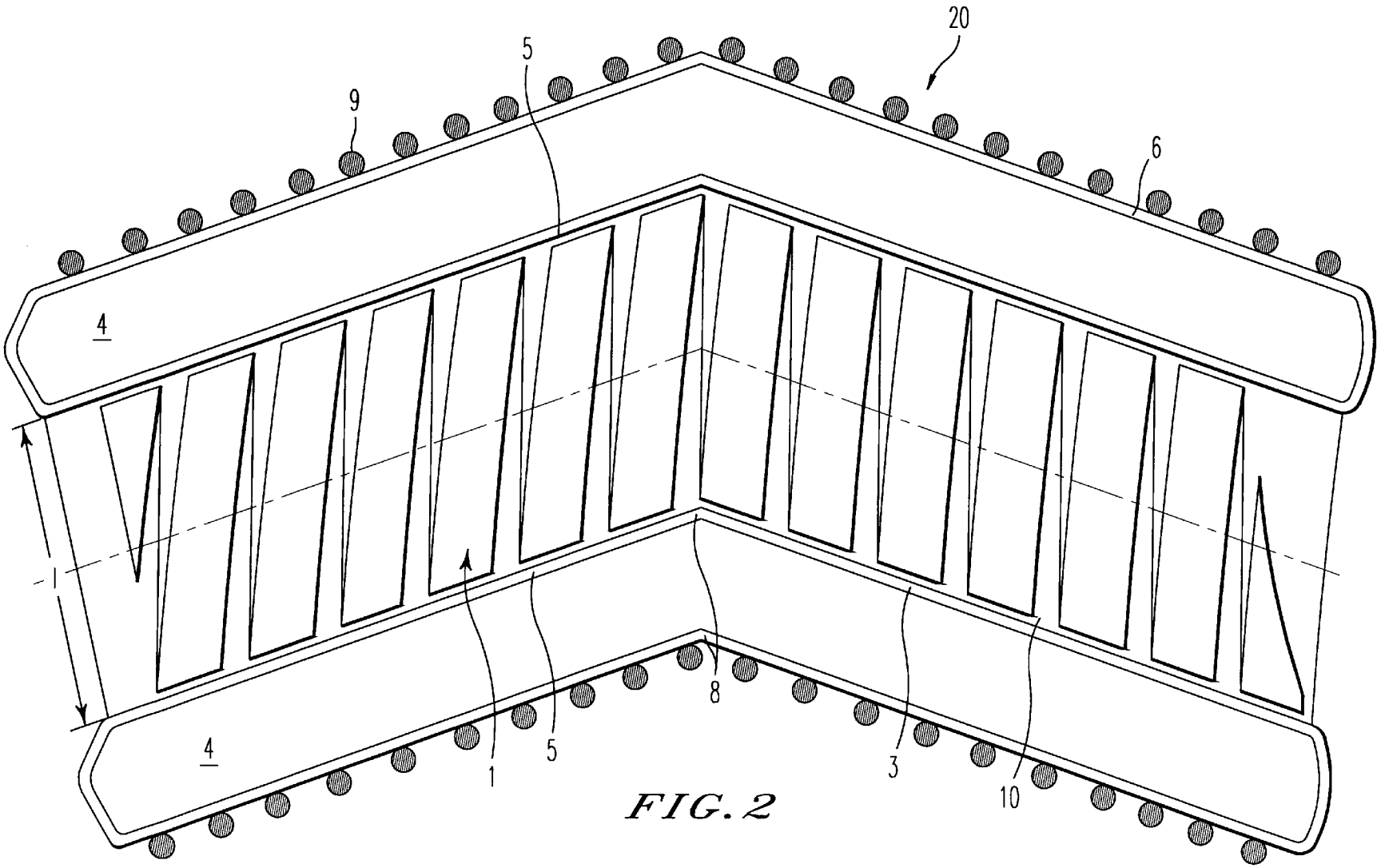
FIG. 2 is a cross sectional view of a discharge lamp having a bent internal tube and including the internal electrode shown in FIG. 1.

FIG. 2 shows a cross sectional portion of a bent excimer reflector lamp 20 that includes the inner electrode 1 of FIG 1. The excimer reflector lamp 20 has a closed discharge space 4 filled with KrCl. The discharge space 4 is bounded on its inner side by an internal tube 5 formed of quartz glass. The discharge space 4 is bounded on its outer side by external tube 6 formed of quartz glass. The internal tube 5 and the external tube 6 are arranged coaxially in relation to each other and are fused to each other at their ends.

As shown in FIG. 2, the excimer reflector lamp 20 has a kink in what is approximately in the middle of the excimer reflector lamp. The internal tube 5 and the external tube 6 have a kink 8 that corresponds to the kink in the excimer reflector lamp 20. The kink 8 forms a bend having an angle of 40°.

An external electrode 9 is positioned on the outer surface of the external tube 6. The external electrode 9 is shaped in the form of a metal net.

The internal electrode 1 is formed with an elastic spiral band 2, as noted above with reference to FIG. 1. The internal diameter, I, of the internal tube 5 is smaller than the external diameter, D, of the internal electrode 1 in the released state (i.e. when the elastic spiral band is not compressed). Preferably, I is equal to 16 mm, and D is equal to 17 mm when the internal electrode is in the released state. As a result, the spiral band 2 of the internal electrode 1 lies fixed with its outer side 3 pressing outwardly against an internal wall 10 of the internal tube 5. (Note that in FIG. 2, the space between the internal electrode 1 and the internal wall 10 is shown for the sake of clarity only.) The spiral band 1 can easily be inserted into the internal tube 5 by drawing (or stretching) it outward along its long axis. The more narrowly the internal tube 5 is rolled, the more its external diameter, D, is narrowed. After the internal electrode 1 is drawn outward, its external diameter, D, decreases, and the internal electrode 1 can be inserted within the internal tube 5. Once the internal electrode is inserted into the internal tube 5, it is released (to the extent possible) so that its external diameter, D, increases. As a result, the internal electrode 1 presses outwardly against the internal wall 10 of the internal tube 5, despite the kink 8.

Due to the flat contact surface of the outer side 3 contacting the internal wall 10, a homogenization of the electric field is attained in the discharge space 4. Consequently, the distribution of filaments is homogenized. The spiral shape of the internal electrode 1 acts to prevent the filaments from wandering, even when the internal electrode 1 is used in an excimer reflector lamp with a vertical orientation. Due to the polished, sparkling outer side 3, the internal electrode 1 serves as a reflector.

Obviously, numerous modifications and variations of the present invention are possible in light of the above teachings. For example, the discharge lamp of the present invention may be used as an excimer reflector lamp in combination with a dipping lamp. It is therefore to be understood that within the scope of the appended claims, the invention may be practiced otherwise than as specifically described herein.

What is claimed is:

1. A discharge lamp, comprising:

an external tube formed of dielectric material;

an internal tube formed of dielectric material and including an internal wall, the external tube and the internal tube defining a discharge space;

an external electrode arranged proximate the external tube; and an internal electrode adjacent an inner wall of the internal tube, the internal electrode including an elastic spiral band, which in a released state, has an external diameter, D, that is larger than an internal diameter, I, of the internal tube.

2. A discharge lamp according to claim 1, wherein the spiral band has a flat cross section and has a breadth between 3 mm and 30 mm.

3. A discharge lamp according to claim 2, wherein the spiral band has a breadth between 5 mm and 10 mm.

4. A discharge lamp according to claim 3, further comprising:

a filler gas within the discharge space, the filler gas forming excimers when a high voltage is applied between the internal electrode and the external electrode.

5. A discharge lamp according to claim 1, wherein the spiral band defines gaps between adjacent winding segments of the spiral band, the gaps having gap widths of between 0.5 mm and 5 mm.

6. A discharge lamp according to claim 5, wherein the spiral band has a flat cross section and has a breadth between 3 mm and 30 mm.

7. A discharge lamp according to claim 6, wherein the spiral band has a breadth between 5 mm and 10 mm.

8. A discharge lamp according to claim 5, wherein the gap widths are between 0.5 mm and 2 mm.

9. A discharge lamp according to claim 8, wherein the spiral band has a flat cross section and has a breadth between 3 mm and 30 mm.

10. A discharge lamp according to claim 9, wherein the spiral band has a flat cross section and has a breadth between 5 mm and 10 mm.

11. A discharge lamp according to claim 1, wherein the spiral band has a thickness between 0.1 mm and 1 mm.

12. A discharge lamp according to claim 11, wherein the spiral band has a flat cross section and has a breadth between 3 mm and 30 mm.

13. A discharge lamp according to claim 12, wherein the spiral band defines gaps between adjacent winding segments of the spiral band, the gaps having gap widths of between 0.5 mm and 5 mm.

14. A discharge lamp according to claim 13, wherein the spiral band has a breadth between 5 mm and 10 mm.

15. A discharge lamp according to claim 14, wherein the spiral band defines gaps between adjacent winding segments of the spiral band, the gaps having gap widths of between 0.5 mm and 2 mm.

16. A discharge lamp according to claim 1, wherein an outer side of the spiral band faces the discharge space and is formed of a material that reflects UV radiation.

17. A discharge lamp according to claim 1, wherein spiral band is formed of 18/8 CrNi steel.

18. A discharge lamp according to claim 1, wherein the internal tube is bent.

19. A discharge lamp according to claim 18, wherein the spiral band has a flat cross section and has a breadth between 3 mm and 30 mm.

20. A discharge lamp according to claim 1, further comprising:

a filler gas within the discharge space, the filler gas forming excimers when a high voltage is applied between the internal electrode and the external electrode.

* * * * *